US007293767B2

(12) United States Patent
Shibabuki et al.

(10) Patent No.: US 7,293,767 B2
(45) Date of Patent: Nov. 13, 2007

(54) SHEET SUCKING/FEEDING DEVICE

(75) Inventors: Tadanobu Shibabuki, Kanagawa (JP); Kazuoki Komiyama, Kanagawa (JP); Yoshinori Kawamura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 64 days.

(21) Appl. No.: 10/727,622

(22) Filed: Dec. 5, 2003

(65) Prior Publication Data

US 2004/0108650 A1 Jun. 10, 2004

(30) Foreign Application Priority Data

Dec. 10, 2002 (JP) ..... 2002-358319

(51) Int. Cl.
*B65H 3/46* (2006.01)

(52) U.S. Cl. ..... 271/106; 271/91; 271/95; 271/103

(58) Field of Classification Search ..... 271/90, 271/91, 95, 106, 103
See application file for complete search history.

(56) References Cited

U.S. PATENT DOCUMENTS 4,189,136 A * 2/1980 Robinette ..... 271/12
6,729,837 B1 * 5/2004 Ono et al. ..... 414/797
6,886,827 B2 * 5/2005 Dachtler ..... 271/106
2002/0047234 A1 * 4/2002 Ono et al. ..... 271/90

FOREIGN PATENT DOCUMENTS

JP 61136838 A * 6/1986
JP 62215441 A * 9/1987
JP 8-268585 10/1996
JP 2001-151360 A 6/2001
JP 2002-128297 A 5/2002
JP 8-259015 A 10/2006

* cited by examiner

*Primary Examiner*—Patrick Mackey
*Assistant Examiner*—Kaitlin Joerger
(74) *Attorney, Agent, or Firm*—Sughrue Mion, PLLC

(57) ABSTRACT

In a sheet sucking/feeding device, actuators are independently and individually connected respectively to plural suction cups. At a point in time when a printing plate is sucked and raised up by a predetermined amount, every other one of the actuators is simultaneously operated such that the suction cups connected to the operated actuators are displaced upwardly. The sucked uppermost printing plate is curved so as to become wavy. Air enters in between the uppermost printing plate and a next printing plate therebeneath such that that printing plate therebeneath is disjoined (separated). Only the uppermost printing plate is stably removed and fed out.

20 Claims, 9 Drawing Sheets

SHEET SUCKING/FEEDING DEVICE

CROSS-REFERENCE TO RELATED APPLICATION

This application claims priority under 35 USC 119 from Japanese Patent Application No. 2002-358319, the disclosure of which is incorporated by reference herein.

BACKGROUND OF THE INVENTION

1. Technical Field

The present invention relates to a sheet sucking/feeding device which sucks an uppermost sheet among a plurality of stacked sheets, and separates this uppermost sheet from another sheet therebeneath, and feeds out the uppermost sheet.

2. Description of the Related Art

A technique in which, by using a printing plate (e.g., a PS plate, a thermal plate, a photopolymer plate) in which a recording layer (photosensitive layer) is provided on a support, an image is recorded directly by a laser beam or the like onto the photosensitive layer of the printing plate, has come to be developed as a printing plate exposing device. With this technique, it is possible to quickly record an image onto a printing plate.

In an automatic printing plate exposing device using the technique of recording images onto printing plates, large numbers of printing plates are stacked and accommodated in cassettes. The image forming surface of the printing plate is easily scratched. In order to protect the image forming surface, protective sheets (interleaf sheets) are superposed on the image forming surfaces of the printing plates. Sets of the superposed printing plate and interleaf sheet are successively stacked in layers within the cassette. When a printing plate is to be removed and fed out, one end portion of the uppermost printing plate among the plural printing plates stacked in the cassette is sucked by suction cups so as to separate this printing plate from the others. The printing plates are thereby taken out one-by-one, and are fed sheet-by-sheet (conveyed and fed) to the subsequent process (e.g., an exposure process) while being inverted.

However, when the printing plates are fed out sheet-by-sheet while being sucked by suction cups and taken out one-by-one and inverted as described above, there are cases in which, due static electricity between or sticking due to a vacuum between the uppermost printing plate which the suction cups are sucking and the next printing plate (the printing plate therebeneath), the next printing plate (the printing plate therebeneath) also is lifted up.

Therefore, conventionally, a "separating plate" has been provided along the locus of movement along which the printing plate is lifted up and raised while being sucked by the suction cups (e.g., in the corner portion of the top end of the cassette) Due to the printing plate passing by the "separating plate" while contacting the "separating plate" or being temporarily stopped while contacting the "separating plate", the next printing plate (the printing plate therebeneath) is separated therefrom. Refer to Japanese Patent Application Laid-Open (JP-A) Nos. 2002-128297 and 2001-151360.

However, in a method of separating which uses such a "separating plate" (i.e., in a structure in which a "separating plate" is provided at the corner portion of the top end of the cassette for example), this "separating plate" gets in the way at the time when printing plates are loaded into the cassette. The user carries out the operation for inserting and loading the printing plates in while setting the "separating plate" in a withdrawn state (i.e., while keeping the "separating plate" out of the way). This is a cause of deterioration in work efficiency. Further, even if the next printing plate (the printing plate beneath) is separated (disjoined) after passing by the "separating plate" at the time when a printing plate is being removed and fed out from the cassette, that separated next printing plate (the printing plate which was beneath) rides up on the "separating plate", and there is the possibility that problems in sucking may arise during the next sucking/feeding operation. Moreover, the position at which such a "separating plate" is disposed must be adjusted in accordance with the size of the printing plates. The workability deteriorates for this reason as well.

SUMMARY OF THE INVENTION

In view of the aforementioned, an object of the present invention is to provide a sheet sucking/feeding device which, at the time of sucking and feeding out an uppermost sheet among a plurality of stacked sheets, reliably separates this uppermost sheet from the next sheet (the sheet therebeneath), so as to stably feed out the uppermost sheet.

A first aspect of the present invention is sheet sucking/feeding device which sucks an uppermost sheet among a plurality of stacked sheets, and separates the uppermost sheet from a sheet therebeneath and feeds the uppermost sheet out. The device has suction cups which suck the sheet, and a suction cup operation device. The plural suction cups are provided at predetermined intervals along a transverse direction of the sheet. The suction cup operation device can displace at least one suction cup among the plurality of suction cups over a predetermined stroke in a suction cup axial direction independently of others of the suction cups. At a point in time when the sheet is sucked by the plurality of suction cups and raised up by a predetermined amount, the suction cup operation device displaces the at least one suction cup so as to cause the sucked sheet to curve wavily along the transverse direction.

In this sheet sucking/feeding device, the uppermost sheet among the plural stacked sheets is sucked by the plurality of suction cups and fed out.

Here, when the sheet is sucked and fed out, at the point in time when the sheet is sucked and raised up by a predetermined amount (e.g., about 1 mm to about 200 mm), the suction cup operation device is operated, such that at least one suction cup among the plurality of suction cups is displaced. In this way, the sucked uppermost sheet is curved in a wave-like shape along the transverse direction (the direction along which the plural suction cups are arranged). In other words, the sheet is curved in a wave shape at the portion thereof sucked by the displaced suction cup.

As a result, air enters in between the uppermost sheet being sucked by the suction cups, and the next sheet (the sheet therebeneath). The next sheet (the sheet therebeneath) is disjoined (separated), such that only the uppermost sheet is stably removed and fed out.

This case is not a structure in which a so-called "separating plate" is used as in the conventional art. Therefore, a "separating plate" does not get in the way at the time when, for example, printing plates, which are the sheets, are being loaded into the cassette, and the workability does not deteriorate. Further, because there is no "separating plate", the separated next sheet (the sheet beneath) does not ride up on the "separating plate". Problems in sucking at the time of the next sucking/feeding operation can be prevented from occurring, and a stable sucking/feeding operation can be ensured. In addition, the sheet is set in a wavy state due to at least one suction cup among the plural suction cups, which are arranged along the transverse direction of the sheet, being displaced. Therefore, the present invention can be applied as is to sheets of different sizes, and there is no need for adjustment or the like of the position at which the "separating plate" is disposed so as to correspond to the size. For this reason as well, the workability improves and the range of applications is broadened.

Moreover, the timing of the operation of and the number of times of operation of the suction cup operation device (i.e., the timing of the displacement operation or the number of displacements of the suction cups to be displaced, or which of the suction cups are to be displaced) can be set arbitrarily. Therefore, as a result, the speed of generation and the positions of generation of the waves of the sheet which is being curved in a wave-like-form can be set optimally, and the ability to disjoin (ability to separate) the sheet therebeneath can be greatly improved. For example, by moving the positions at which the sheet is curved (the positions of the waves), the entry rate of the air which enters in between that sheet and the sheet therebeneath can be accelerated, and the ability to disjoin (ability to separate) can be greatly improved. Accordingly, the time of the operation for separating/feeding the sheet and the time of the cycles of this separating/feeding operation can be greatly shortened.

In this way, at the sheet sucking/feeding device of the first aspect, at the time when the uppermost sheet among a plurality of stacked sheets is sucked and separated and fed, the ability to disjoin (ability to separate) the sheet therebeneath can be greatly improved. The uppermost sheet can be reliably separated from the sheet therebeneath, and can be stably fed out.

In the sheet sucking/feeding device of the present invention, the suction cup operation device may be actuators connected independently to the respective suction cups. In a case in which the suction cup operation device is actuators, when the sheet is sucked and raised up by the predetermined amount, the suction cup operation device displaces the suction cups by simultaneously driving at least every other one of the actuators.

In a sheet sucking/feeding device using actuators, when the sheet is sucked and raised up by the predetermined amount, at least every other one of the actuators is driven simultaneously such that the suction cups are displaced and the sheet is curved in a wavy form. In this way, air enters in between the uppermost sheet which the suction cups are sucking, and the next sheet (the sheet therebeneath). The next sheet (the sheet beneath) is separated, such that only the uppermost sheet is stably removed and fed out.

Note that, in this case, it is possible to repeatedly drive the at least every other one of the actuators. Or, the driving of the at least every other one of the actuators and the driving of the other actuators can be carried out alternately. In either case, air is reliably made to enter in between the sheet and the other sheet therebeneath.

In addition, there is no need for the actuators which are driven simultaneously to be every other actuator as described above. Structures are possible in which, for example, every third actuator or every fourth actuator is driven simultaneously.

Moreover, the actuators may be structured by solenoids.

In the sheet sucking/feeding device of the present invention, a plurality of groups of actuators are set overall, with at least every other one of the actuators being a group of actuators, and the respective groups of actuators are driven alternately.

In such a sheet sucking/feeding device, a plurality of groups of actuators are set overall, with at least every other one of the actuators being a group of actuators. At the time of sucking and raising the sheet up by a predetermined amount, the respective groups of actuators are driven alternately.

Accordingly, the sheet can be reliably curved into wave shapes, and it is possible to stably remove and feed out only the uppermost sheet.

There is no need for the actuators which form one group to be every other actuator as described above. Structures are possible in which, for example, every third actuator or every fourth actuator are set as a group.

In the sheet sucking/feeding device of the present invention, the suction cup operation device may be a cam mechanism having cams which engage independently with the respective suction cups. When the sheet is sucked and raised up by the predetermined amount, the cam mechanism displaces the suction cups by simultaneously making at least every other one of the cams of the cam mechanism engage.

In a sheet sucking/feeding device using a cam mechanism as the suction cup operation device, when the sheet is sucked and raised up by the predetermined amount, at least every other one of the cams of the cam mechanism are simultaneously engaged such that the suction cups are displaced and the sheet is curved in the form of waves. In this way, air enters in between the uppermost sheet which the suction cups are sucking, and the next sheet (the sheet therebeneath). The next sheet (the sheet beneath) is separated, such that only the uppermost sheet is stably removed and fed out.

In this case, the driving of the at least every other cam of the cams of the cam mechanism (i.e., the engagement with the suction cups) can be repeated plural times. Or, it is possible to alternate the driving of the at least every other cam and the driving of the other cams. Either case is effective as air is reliably made to enter in between the sheet and the other sheet therebeneath.

Moreover, there is no need for the cams which engage the suction cups simultaneously to be every other cam as described above. Structures are possible in which, for example, every third cam or every fourth cam simultaneously engages.

In addition, the respective cams of the cam mechanism may be structured so as to be operated by a single drive source (e.g., a motor). Or, the respective cams can be structured so as to be independently operated by respective actuators (e.g., solenoids).

In the sheet sucking/feeding device of the present invention, a plurality of groups of cams are set overall, with at least every other one of the cams being a group of cams, and the respective groups of cams are operated alternately.

In this sheet sucking/feeding device, a plurality of groups of cams are set overall, with at least every other one of the cams being a group of cams. When the sheet is sucked and raised up by a predetermined amount, the respective groups of cams are operated alternately.

Accordingly, the sheet can be even more reliably curved into wave shapes, and it is possible to stably remove and feed out only the uppermost sheet.

There is no need for the cams which form one group to be every other cam as described above. Structures are possible in which, for example, every third cam or every fourth cam are set as a group.

In the sheet sucking/feeding device of the present invention, the suction cups may include highly-rigid suction cups at which a rigidity of a skirt portion is greater than a rigidity of a skirt portion of other suction cups. The suction cup operation device may be a pressure reducer which reduces a suction negative pressure of at least the highly-rigid suction cups among the suction cups. In this structure, when the sheet is sucked and raised up by the predetermined amount, the suction cup operation device deforms the skirt portions of the highly-rigid suction cups by reducing the suction negative pressure of the highly-rigid suction cups by the pressure reducer.

In this sheet sucking/feeding device, when the sheet is sucked and raised up by a predetermined amount, the suction negative pressure of the highly-rigid suction cups is reduced by the pressure reducer. The skirt portions of the highly-rigid suction cups are thereby deformed. Namely, the skirt portions are extended so as to approach their natural states, and the sucked positions of the sheet are displaced.

Therefore, the sheet is curved in the form of waves at the regions thereof sucked by the highly-rigid suction cups whose suction positions have been displaced. In this way, air enters in between the uppermost sheet which the suction cups are sucking, and the next sheet (the sheet therebeneath). The next sheet (the sheet beneath) is separated, such that only the uppermost sheet is stably removed and fed out.

Note that, in this case, a structure in which every other suction cup is a highly-rigid suction cup is often used in actuality. However, this condition of every other suction cup being a highly-rigid suction cup is a sufficient condition. For example, structures in which every third suction cup or every fourth suction cup is a highly-rigid suction cup are possible.

It is possible for the reduction in the suction negative pressure by the pressure reducer to be carried out for only the highly-rigid suction cups (for the highly-rigid suction cups alone). Or, the suction negative pressures of the highly-rigid suction cups and the other suction cups may be reduced simultaneously. As yet another alternative, the operation of reducing the suction negative pressure of the suction cups (the highly-rigid suction cups) may be carried out repeatedly plural times. In this case, air enters in even more reliably between the sheet and the other sheet therebeneath, which is even more effective.

In the sheet sucking/feeding device of the present invention, the suction cups may include highly-rigid suction cups at which a rigidity of a skirt portion is greater than a rigidity of a skirt portion of other suction cups. The suction cup operation device may be a pressure reducer reducing a suction negative pressure of the respective suction cups. In the case of this structure, when the sheet is sucked and raised up by the predetermined amount, the suction cup operation device deforms the skirt portions of the respective suction cups by simultaneously reducing the suction negative pressure of the respective suction cups by the pressure reducer.

In this sheet sucking/feeding device, when the sheet is sucked and raised up by a predetermined amount, the suction negative pressure of each suction cup is reduced simultaneously by the pressure reducer. The skirt portions of the respective suction cups are thereby deformed (i.e., the skirt portions are extended so as to approach their natural states). However, the skirt portions of the highly-rigid suction cups are deformed more than the skirt portions of the other suction cups (are extended so as to approach their natural states even more). Therefore, the positions at which the sheet is sucked by the highly-rigid suction cups are greatly displaced.

Thus, the sheet is curved in the form of waves at the regions thereof sucked by the highly-rigid suction cups whose suction positions have been displaced. In this way, air enters in between the uppermost sheet which the suction cups are sucking, and the next sheet (the sheet therebeneath). The next sheet (the sheet beneath) is separated, such that only the uppermost sheet is stably removed and fed out.

Note that, in this case, a structure in which every other suction cup is a highly-rigid suction cup is often used. However, it suffices for every other suction cup to be a highly-rigid suction cup, and, for example, structures in which every third suction cup or every fourth suction cup is a highly-rigid suction cup are possible.

In addition, the operation of reducing the suction negative pressure of the respective suction cups may be repeated plural times. In this case, air enters in even more reliably between the sheet and the other sheet therebeneath, which is even more effective.

In the sheet sucking/feeding device of the present invention, the skirt portions of the respective suction cups may have the same rigidity. The suction cup operation device may include a pressure reducer which individually reduces the suction negative pressures of the respective suction cups. In the case of this structure, when the sheet is sucked and raised up by the predetermined amount, the suction cup operation device reduces the suction negative pressure of at least one suction cup among the respective suction cups by the pressure reducer so as to deform the skirt portion of that at least one suction cup.

In the sheet sucking/feeding device of the present invention, when the sheet is sucked and raised up by a predetermined amount, the suction negative pressure of at least one suction cup among the respective suction cups is reduced by the pressure reducer. The skirt portions of those suction cups are thereby deformed. In other words, the skirt portions are extended so as to approach their natural states, and their sheet sucking positions are displaced.

Thus, the sheet is curved in the form of waves at the regions thereof sucked by the suction cups whose suction positions have been displaced. In this way, air enters in between the uppermost sheet which the suction cups are sucking, and the next sheet (the sheet therebeneath). The next sheet (the sheet beneath) is separated, such that only the uppermost sheet is stably removed and fed out.

Note that, in this case, a structure in which the suction cups whose suction negative pressures are reduced are every other suction cup is preferable. However, it suffices to use at least every other suction cup. For example, structures in which the suction negative pressures of every third suction cup or every fourth suction cup are reduced are possible.

In addition, the operation of reducing the suction negative pressures of the suction cups may be repeated plural times. In this case as well, air enters in reliably between the sheet and the other sheet therebeneath, which is effective.

DETAILED DESCRIPTION OF THE INVENTION

Figure 3:
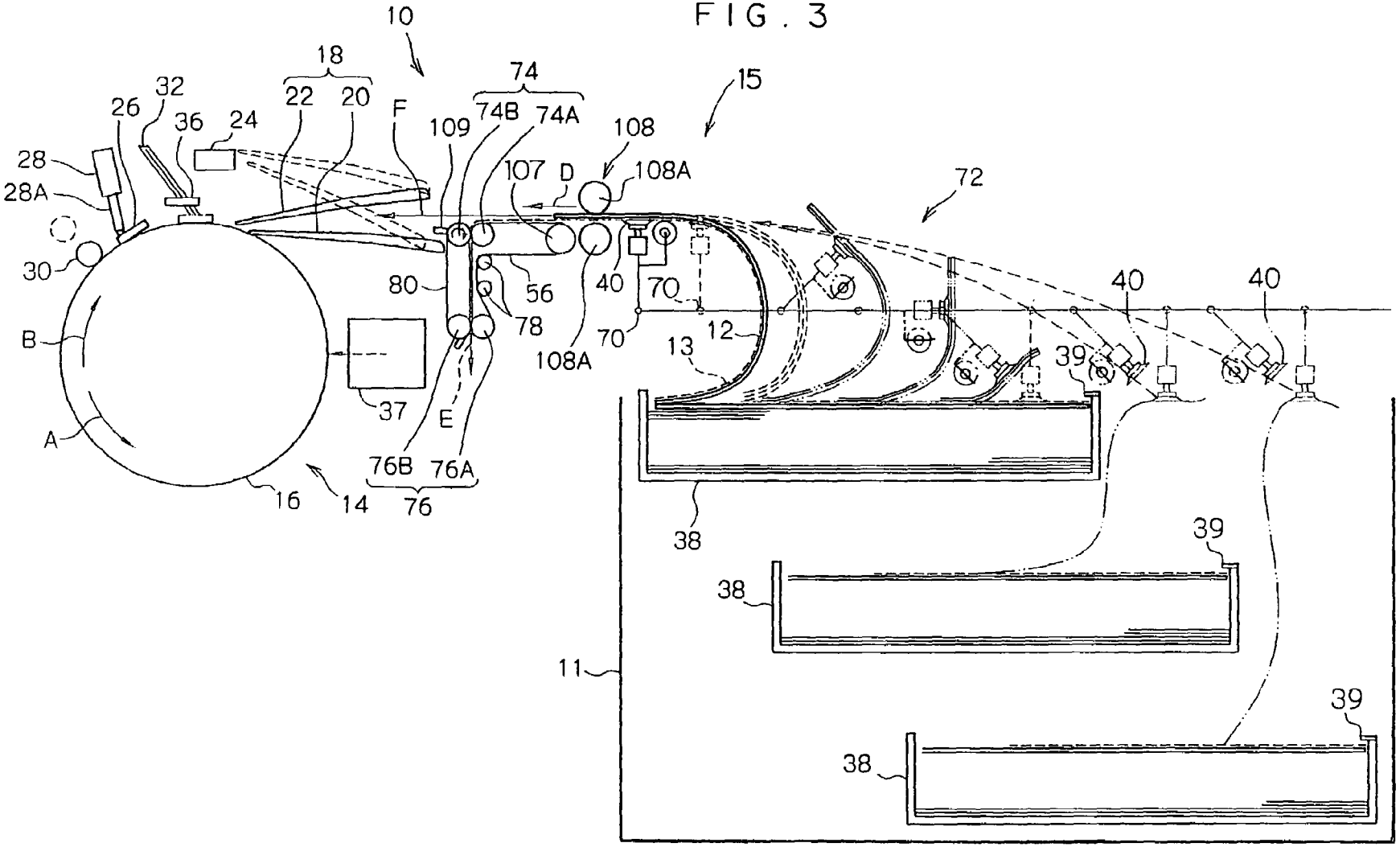
FIG. 3 is a schematic diagram of an automatic printing plate exposing device to which the sheet sucking/feeding devices relating to the embodiments of the present invention are applied.

The schematic overall structure of an automatic printing plate exposing device 10, to which a sheet sucking/feeding device 50 relating to a first embodiment of the present invention is applied, is shown in FIG. 3.

The automatic printing plate exposing device 10 is divided into two main sections which are an exposure section 14, which illuminates a light beam onto an image forming layer of a printing plate 12 so as to expose an image, and a sheet feeding/conveying section 15 which removes the printing plate 12 and conveys the printing plate 12 to the exposure section 14. The printing plate 12, which has been subjected to exposure processing by the automatic printing plate exposure device 10, is fed out to a developing device (not illustrated) which is disposed adjacent to the automatic printing plate exposure device 10.

Structure of Exposure Section

The exposure section 14 is structured such that a rotating drum 16, around whose peripheral surface the printing plate 12 is trained and held, is the main portion of the exposure section 14. The printing plate 12 is guided by a conveying guide unit 18, and is fed in from a direction tangent to the rotating drum 16. The conveying guide unit 18 is structured by a plate supplying guide 20 and a plate discharging guide 22. Conveying rollers 108 and a guide plate 109 are disposed at the side of the conveying guide unit 18 which side borders on the sheet feeding/conveying section 15.

The relative positional relationship of the plate supplying guide 20 and the plate discharging guide 22 of the conveying guide unit 18 is such that the plate supplying guide 20 and the plate discharging guide 22 form a sideways V shape. The plate supplying guide 20 and the plate discharging guide 22 rotate by predetermined angles around the right end portion sides thereof in FIG. 3. Due to this rotation, the plate supplying guide 20 can be selectively disposed at a position corresponding to the rotating drum 16 (a position of being disposed in a direction tangent to the rotating drum 16), and a position of inserting the printing plate 12 into a puncher 24 which is provided above the rotating drum 16. The printing plate 12 which has been fed in from the sheet feeding/conveying section 15 is first guided by the plate supplying guide 20 and fed into the puncher 24 where notches for positioning are formed in the leading end of the printing plate 12. Further, after the printing plate 12 undergoes processing at the puncher 24 as needed, the printing plate 12 is returned to the plate supplying guide 20. The printing plate 12 is thereby moved to a position corresponding to the rotating drum 16.

The rotating drum 16 is rotated by an unillustrated driving means in a direction in which the printing plate 12 is attached and exposed (the direction of arrow A in FIG. 3), and in a direction in which the printing plate 12 is removed (the direction of arrow B in FIG. 3) which is opposite to the attaching/exposing direction.

Leading end chucks 26 are mounted to predetermined positions of the outer peripheral surface of the rotating drum 16. At the exposure section 14, when the printing plate 12 is to be attached to the rotating drum 16, first, the rotating drum 16 is stopped at a position (printing plate attaching position) at which the leading end chucks 26 oppose the leading end of the printing plate 12 which has been fed in by the plate supplying guide 20 of the conveying guide unit 18.

An attaching unit 28 is provided in the exposure section 14 so as to oppose the leading end chucks 26 at the printing plate attaching position. Due to extending/retracting rods 28A of the attaching unit 28 extending and one end sides of the leading end chucks 26 being pressed, the printing plate 12 can be inserted between the leading end chucks 26 and the peripheral surface of the rotating drum 16. In the state in which the leading end of the printing plate 12 is inserted between the leading end chucks 26 and the rotating drum 16, the extending/retracting rods 28A of the attaching unit 28 are pulled back such that their pressing of the leading end chucks 26 is released. In this way, the leading end of the printing plate 12 is nipped and held between the leading end chucks 26 and the peripheral surface of the rotating drum 16. At this time, the printing plate 12 is positioned due to the leading end thereof abutting positioning pins (not shown) provided on the rotating drum 16. When the leading end of the printing plate 12 is fixed to the rotating drum 16, the rotating drum 16 is rotated in the attaching/exposing direction. In this way, the printing plate 12, which has been fed in from the plate supplying guide 20 of the conveying guide unit 18, is trained about the peripheral surface of the rotating drum 16.

A squeeze roller 30 is provided at the downstream side, in the attaching/exposing direction (the direction of arrow A in FIG. 3), of the printing plate attaching position, in a vicinity of the peripheral surface of the rotating drum 16. Due to the squeeze roller 30 moving toward the rotating drum 16, the printing plate 12 which is trained on the rotating drum 16 is pushed toward the rotating drum 16 and is made to fit tightly to the peripheral surface of the rotating drum 16.

Further, a trailing end chuck attaching/detaching unit 32 is disposed in the exposure section 14 in a vicinity of the upstream side of the leading end chucks 26 in the attaching/exposing direction of the rotating drum 16. At the trailing end chuck attaching/detaching unit 32, trailing end chucks 36 move along guides which project out toward the rotating drum 16. When the trailing end of the printing plate 12 which is trained on the rotating drum 16 opposes the trailing end chuck attaching/detaching unit 32, the trailing end chucks 36 are moved toward the rotating drum 16 and attached to predetermined positions of the rotating drum 16. In this way, the trailing end of the printing plate 12 is nipped and held between the trailing end chucks 36 and the rotating drum 16.

When the leading end and the trailing end of the printing plate 12 are held at the rotating drum 16, the squeeze roller 30 is moved away (refer to the chain line in FIG. 3). Thereafter, in the exposure section 14, while rotating the rotating drum 16 at high speed at a predetermined rotational speed, a light beam, which is modulated on the basis of image data, is irradiated from a recording head portion 37 synchronously with the rotation of the rotating drum 16. In this way, the printing plate 12 is scan-exposed on the basis of the image data.

When the scan-exposure of the printing plate 12 has been completed, the rotating drum 16 is temporarily stopped at a position at which the trailing end chucks 36, which are holding the trailing end of the printing plate 12, oppose the trailing end chuck attaching/detaching unit 32. The trailing end chuck attaching/detaching unit 32 removes the trailing end chucks 36 from the rotating drum 16. In this way, the trailing end of the printing plate 12 is freed. Thereafter, by rotating the rotating drum 16 in the direction of removing the printing plate 12, the printing plate 12 is expelled, from the trailing end side thereof, to the plate discharging guide 22 of the conveying guide unit 18 along a direction tangent to the rotating drum 16. Thereafter, the printing plate 12 is conveyed to the developing device which is the subsequent process.

Structure of Sheet Feeding/Conveying Section 15

Figure 4:
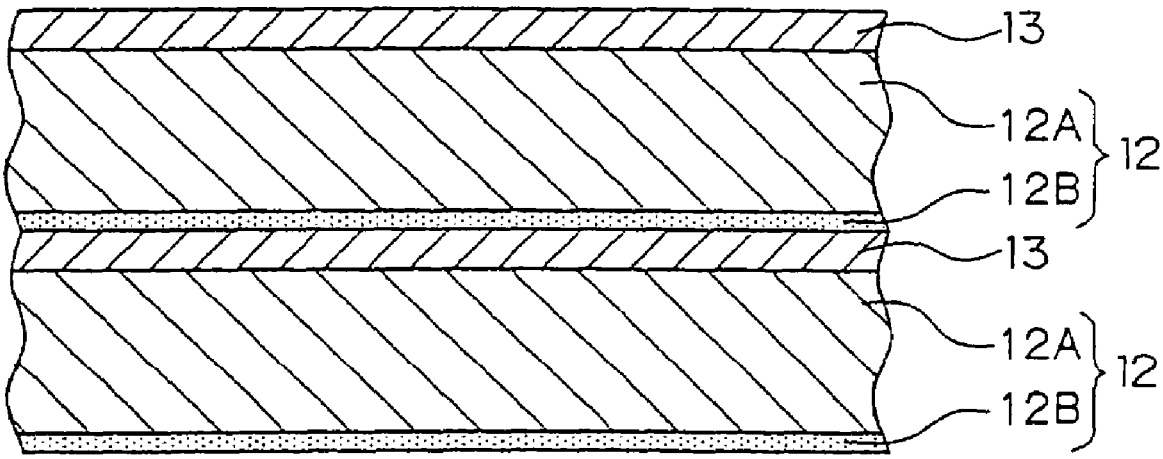
FIG. 4 is a side view showing a state in which interleaf sheets and printing plates, which are sucked by the sheet sucking/feeding devices relating to the embodiments of the present invention, are stacked within a cassette.

As shown in FIG. 3, a cassette stacking section 11 occupying a predetermined space is provided in the sheet feeding/conveying section 15. Cassettes 38, which are parallel to the surface on which the device is placed, are provided in the cassette stacking section 11. A plurality of cassettes 38 are provided one above the other at plural levels. A plurality of the printing plates 12 are accommodated in each of the cassettes 38. As shown in FIG. 4, the printing plates 12 are structured such that an emulsion surface 12B (image recording surface) is formed on a support 12A. Interleaf sheets 13, which are protective sheets for protecting the emulsion surfaces 12B of the printing plates 12, and the printing plate 12, which are disposed such that their emulsion surfaces 12B face downwardly, are accommodated within the cassette 38 so as to be stacked alternately.

Here, the cassettes 38 in the present embodiment are stacked one above the other so as to be offset from one another in the horizontal direction. The amounts of offset are set on the basis of the loci of movement at the time when the printing plates 12 (and the interleaf sheets 13 which are protective sheets) are carried out from the cassettes 38 by suction cups 40 of a sucking/feeding device 50 which will be described later.

The sucking/feeding device 50 which will be described in detail later is provided in the sheet feeding/conveying section 15. In the sucking/feeding device 50, a plurality of the suction cups 40 are disposed at predetermined pitch intervals along the transverse direction of the printing plate 12. The suction cups 40 are classified into a plurality of systems. By selecting a system on the basis of the size of the printing plate 12 and imparting a sucking function to the selected system, the printing plate 12 can be sucked in a well-balanced manner.

A moving mechanism 72 is provided above the cassettes 38. In the moving mechanism 72, the suction cups 40 are supported so as to hang downward, and base points 70, which support the suction cups 40 in this downward hanging state, are movable substantially horizontally in the left-right direction of the cassettes 38 in FIG. 3. The moving mechanism 72 is a structure for moving the sucking/feeding device 50 in the horizontal direction while inverting the sucking/feeding device 50. The base points 70 which support the plural suction cups 52 are rotatable.

When the printing plate 12 is to be carried out from the cassette 38 by the sucking/feeding device 50, because the interleaf sheets 13 and the printing plates 12, whose emulsion surfaces 12B are facing downward, are stacked alternately in the cassette 38, the suction cups 40 contact the interleaf sheet 13 which is the topmost layer within the cassette 38. When suction force is imparted to the suction cups 40 at the point in time when they contact the uppermost interleaf sheet 13, the suction force is applied to the uppermost interleaf sheet 13, and is transferred as well as to the printing plate 12 immediately therebeneath. The interleaf sheet 13 and the printing plate 12 are thereby sucked and lifted up (together and simultaneously) as a pair (as one set). Although the raising and lowering of the suction cups 40 is omitted from illustration in FIG. 3, the suction cups 40 are lowered to the heightwise position of each cassette 38, and separate (disjoin) the interleaf sheet 13 and the printing plate 12, which are other than and which are beneath the interleaf sheet 13 and the printing plate 12 which are being sucked, by a "separating operation" which will be described in detail later, and are raised to their topmost positions in this state.

At this time, in the vertical direction lifting out of the printing plates 12 from the cassettes 38 of the respective levels, there are different loci of movement due to the lengths (left-right direction lengths in FIG. 3) of the printing plates 12. Namely, in a case in which three levels of the cassettes 38 are provided as in the present embodiment, when the printing plate 12 is lifted up out from the uppermost cassette 38, only the leading end portion of the printing plate 12 is lifted up. When the printing plate 12 is to be lifted up out from the middle cassette 38, about ⅔ of the printing plate 12 is lifted up. When the printing plate 12 is to be lifted up out from the lowermost cassette 38, the entire printing plate 12 is in a state of being suspended downward.

In this state, a plate which supports the suction cups 40 begins to rotate counterclockwise in FIG. 3 around the base points 70, and begins to move toward the left, in FIG. 3, of the cassettes 38. In this way, the suction points of the suction cups 40 move while tracing a so-called cycloid curve. The amounts by which the respective cassettes 38 are offset are set on the basis of the loci of movement. Therefore, regardless of which cassette 38 the printing plate 12 and the interleaf sheet 13 are lifted out from, the printing plate 12 and the interleaf sheet 13 can be lifted out without being interfered with by the cassettes 38 thereabove.

Note that there is usually absolutely no interference between the printing plate 12 and the cassettes 38 thereabove. However, the surface abutting the cassette 38 is the interleaf sheet 13 (the reverse surface side of the printing plate 12). Therefore, assuming that the space, as seen in plan view, of the cassette stacking section 11 is made to be small, the printing plate 12 may slightly contact the cassette 38 when the suction cups 40 are moving in the left-right direction (the horizontal direction), provided that contact at the time when the suction cups 40 are moving in the raising/lowering direction (the vertical direction) and are being rotated is avoided.

When the suction cups 40 have been rotated by 180°, the interleaf sheet 13 is now at the lower side and the printing plate 12 is now at the upper side in the state shown in FIG. 3, and the interleaf sheet 13 and the printing plate 12 are transferred to the conveying rollers 108.

A belt 56 is trained around a roller 107 which is adjacent to a roller 108A which is the lower roller of the conveying rollers 108. The belt 56 is also trained around a right roller 74A of a pair of rollers 74 which are disposed in a vicinity of the conveying guide unit 18 of the exposure section 14. A pair of rollers 76 is provided beneath the pair of rollers 74. The belt 56 is trained around a right side roller 76A of the lower rollers 76, and along a pair of small rollers 78 so as to form a substantially L-shaped loop overall. The belt 56 is driven in the direction of arrow D in FIG. 3.

A belt 80 spans between a left side roller 74B of the upper pair of rollers 74 and a left side roller 76B of the lower pair of rollers 76.

The roller 74B is a roller which rotates in the direction opposite to the conveying direction. The frictional force between the roller 74B and the interleaf sheet 13 is great. During the time of usual conveying, the roller 74B is withdrawn beneath the plane of conveying. After the printing plate 12 and the interleaf sheet 13 have passed above the roller 74B, the roller 74B is raised. Due to the frictional force, the interleaf sheet 13 is pulled in between the rollers 74, and the roller 74B is then withdrawn. The interleaf sheet 13 is fed to the lower rollers 76 and discarded (refer to the chain line arrow E in FIG. 3).

The printing plate 12 passes above the upper pair of rollers 74 and is fed to the plate supplying guide 20 (refer to the solid-line arrow F in FIG. 3).

Structure of Sucking/Feeding Device 50

Figure 1:
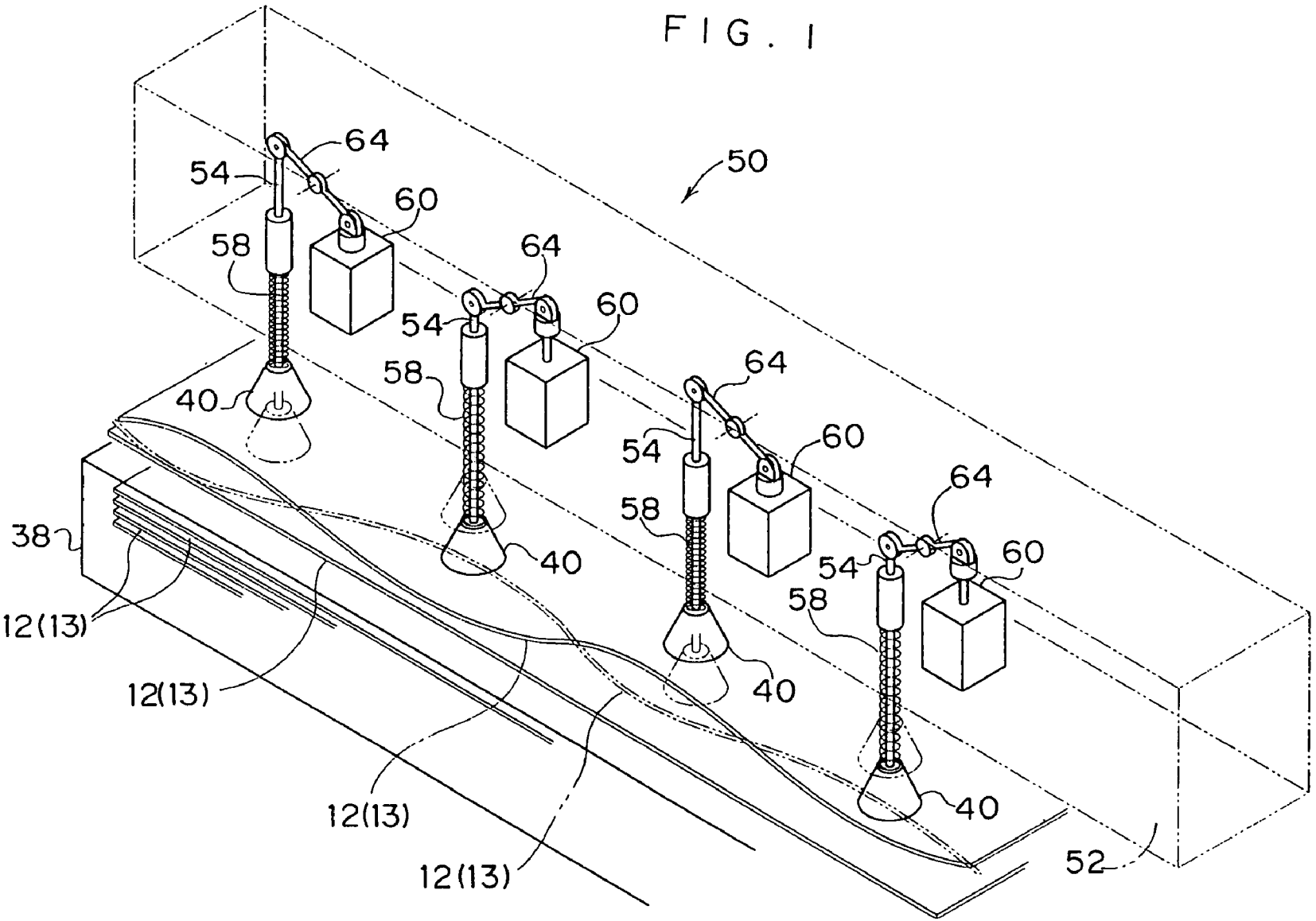
FIG. 1 is a perspective view showing the structure of a sheet sucking/feeding device relating to a first embodiment of the present invention.
Figure 2:
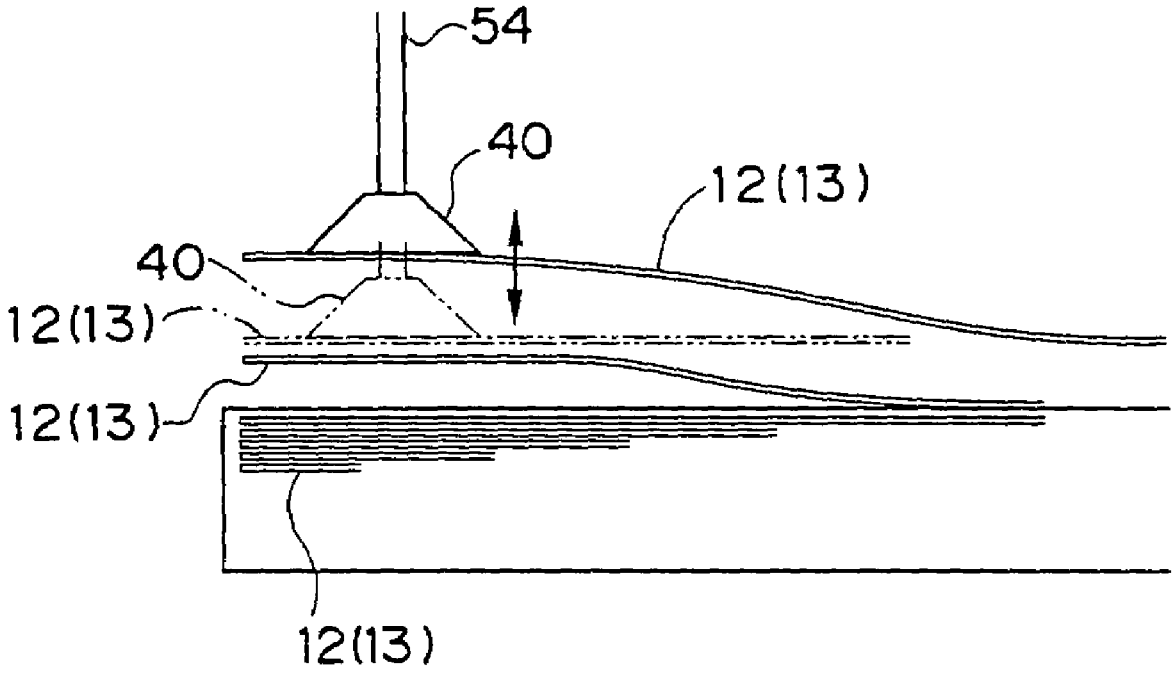
FIG. 2 is a side view showing a state at the time of sucking and feeding in the sheet sucking/feeding device relating to the first embodiment of the present invention.

The structure of the sucking/feeding device 50 relating to the present first embodiment is shown in perspective view in FIG. 1.

At the sucking/feeding device 50, the plural suction cups 40 are disposed at predetermined intervals at a base plate 52 which is provided along the transverse direction of the printing plate 12. Note that, in FIG. 1, only four suction cups 40 are illustrated.

A spring 58 is wound around a linear shaft 54 of each suction cup 40, so as to ensure a predetermined buffer stroke. Actuators 60, which serve as a suction cup operation device, are independently and individually connected to the respective suction cups 40. The actuator 60 is formed by applying a solenoid for example, and is connected to the linear shaft 54 of the suction cup 40 via a lift-up lever 64. By operating the actuator 60 (i.e., by turning the actuator 60 on), the actuator 60 can lift up (displace) the suction cup 40 by a predetermined amount within the range of the buffer stroke. Moreover, in this case, at the point in time when the printing plate 12 is sucked by the plurality of suction cups 40 and is raised up by a predetermined amount (e.g., about 1 mm to about 200 mm), due to at least one of the actuators 60 operating, at least one of the suction cups 40 is displaced, and the printing plate 12 which is being sucked is curved in wave-like shapes along the transverse direction thereof.

Note that, in the present first embodiment, setting is carried out such that, when the printing plate 12 is sucked and lifted up by a predetermined amount, every other actuator 60 is operated simultaneously. In FIG. 1, the odd-numbered actuators 60 are considered to be a group and are operated simultaneously, and the even-numbered actuators 60 are considered to be a group and are operated simultaneously. Further, in this case, the operation of one of the groups of actuators 60, which are grouped together as described above, may be repeated plural times, or operations of the respective groups of actuators 60 may be carried out alternately.

Next, operation of the present first embodiment will be described.

At the automatic printing plate exposing device 10 having the above-described structure, when the printing plate 12 (and the interleaf sheet 13) are to be taken out from the cassette 38, one of the cassettes 38, which are placed one above the other in plural levels, is specified. When the cassette 38 is specified, the suction cups 40 are positioned in a vicinity of the right end portion (in FIG. 3) of the specified cassette 38. After positioning, the sucking/feeding device 50 (the suction cups 40) is lowered to the heightwise position of the cassette 38. Although the heightwise positions of the cassettes 38 are respectively different, in each case, the movement of the sucking/feeding device 50 is simple, rectilinear movement.

When the sucking/feeding device 50 is lowered, the suction cups 40 contact the interleaf sheet 13 which is the uppermost material in the specified cassette 38. In this state, sucking by the suction cups 40 is started, and raising of the suction cups 40 is started. During this raising, the suction cups 40 suck, together with the interleaf sheet 13 which is the topmost layer, the printing plate 12.

Here, at the point in time when the printing plate 12 has been sucked and raised up by a predetermined amount (e.g., about 1 mm to about 200 mm), the suction cup operation device, i.e., every other actuator 60, is simultaneously operated. (In FIG. 1, the group of the odd-numbered actuators 60 are simultaneously operated, or the group of the even-numbered actuators 60 are simultaneously operated.)

Therefore, the suction cups 40 connected to the actuators 60 which are being operated are displaced upwardly. In this way, the uppermost printing plate 12 which is being sucked is curved in the shape of waves along the transverse direction (the direction along which the plural suction cups 40 are arranged) i.e., the printing plate 12 curves at the portions thereof sucked by the displaced suction cups 40 so as become wavy.

As a result, air enters in between the uppermost printing plate 12 which is being sucked by the suction cups 40 and the next (lower) printing plate 12 (interleaf sheet 13). That next (lower) printing plate 12 (interleaf sheet 13) is disjoined (separated) such that only the uppermost printing plate 12 is stably carried out (singly fed out) from the cassette 38.

In this case, as described above, every other one of the actuators 60 is operated simultaneously. In other words, in FIG. 1, the odd-numbered actuators 60 are operated simultaneously. Or, the even-numbered actuators 60 may be operated simultaneously. However, the present invention is not limited to the same. The operation of said every other actuator 60 may be repeated several times. Or, the operations of the odd-numbered actuators 60 and the even-numbered actuators 60 may be carried out alternately. In these cases, air enters in even more reliably between the sucked printing plate 12 and the printing plate 12 therebeneath, which is even more effective.

The actuators 60 which are operated simultaneously (i.e., which are considered to be a group) are not limited to the structure of every other actuator 60 as described above. For example, a structure may be used in which every third actuator 60 or every fourth actuator 60 are operated simultaneously.

When the suction cups 40 of the sucking/feeding device 50 lift the printing plate 12 (and the interleaf sheet 13) up out of the cassette 38 and reach their topmost positions, the suction cups 40 move horizontally toward the exposure section 14 while rotating 180° around the base points 70. At this time, the printing plate 12 pick-up positions (the points at which the printing plate 12 is sucked by the suction cups 40) move while tracing a so-called cycloid curve. Thus, the printing plate 12 (and the interleaf sheet 13), which have been lifted up out of one of the lower-level cassettes 38 and which intrinsically have a given amount of stiffness, are conveyed while circling around the cassettes 38 thereabove. Thus, there is hardly any contact of the printing plate 12 (and the interleaf sheet 13) with the cassettes 38 thereabove. Note that, because the portion of the printing plate 12 which may contact the cassettes 38 thereabove is the reverse surface side of the printing plate 12, some contact is permitted.

The printing plate 12 (and the interleaf sheet 13) which have been rotated by 180° are transferred to the conveying rollers 108. The interleaf sheet 13 is peeled off from the printing plate 12 by the roller 74B which rotates in the direction opposite to the conveying direction. The peeled-off interleaf sheet 13 is pulled in between the rollers 74, is fed to the lower rollers 76, and is discarded in the unillustrated discard box.

The printing plate 12 continues to be conveyed substantially horizontally on the guide plate 109, and is fed to the plate supplying guide 20. The printing plate 12 on the plate supplying guide 20 is fed to the rotating drum 16, and the leading end portion of the printing plate 12 is held by the leading end chucks 26. In this state, due to the rotating drum 16 rotating, the printing plate 12 is trained tightly onto the peripheral surface of the rotating drum 16. Thereafter, the trailing end of the printing plate 12 is held by the trailing end chucks 36. Preparations for exposure are thereby completed.

In this state, image data is read, and exposure processing by the light beam from the recording head portion 37 is started. The exposure processing is so-called scan-exposure in which the recording head portion 37 is moved in the axial direction of the rotating drum 16 while the rotating drum 16 is rotated at high speed (main scanning).

When exposure processing is completed, the conveying guide unit 18 is switched (the plate discharging guide 22 is made to correspond to the rotating drum 16). Next, the printing plate 12 which is trained on the rotating drum 16 is discharged out from a direction tangent to the rotating drum 16. At this time, the printing plate 12 is fed to the plate discharging guide 22. When the printing plate 12 is fed to the plate discharging guide 22, the conveying guide unit 18 is switched such that the plate discharging guide 22 is made to correspond to the discharge opening, and the printing plate 12 is discharged. The developing section is provided in the discharging direction, and thus, the printing plate 12 is then subjected to developing processing.

Here, as described above, at the time when the interleaf sheet 13 and the printing plate 12 in the cassette 38 are sucked and fed out by the suction cups 40 of the sucking/feeding device 50, specific suction cups 40 are displaced upward such that the sucked uppermost printing plate 12 is curved in wave shapes along the transverse direction (the direction in which the plural suction cups 40 are arranged) i.e., the printing plate 12 curves at the portions thereof sucked by the displaced suction cups 40 so as become wavy. Air enters in between the sucked printing plate 12 and the next (lower) printing plate 12 (interleaf sheet 13), and this next (lower) printing plate 12 (interleaf sheet 13) is disjoined (separated) therefrom. Namely, this is not a structure in which a so-called "separating plate" is used as in the conventional art. Therefore, a "separating plate" does not get in the way at the time when, for example, the printing plates 12 are being loaded into the cassette 38, and the workability does not deteriorate. Further, because there is no "separating plate", the separated next printing plate 12 (the printing plate 12 beneath) does not ride up on the "separating plate". Problems in sucking at the time of the next sucking/feeding operation can be prevented from occurring, and a stable sucking/feeding operation can be ensured. In addition, the printing plate 12 is set in a wavy state due to at least one suction cup 40 among the plural suction cups 40, which are arranged along the transverse direction of the printing plate 12, being displaced. Therefore, the present invention can be applied as is to the printing plates 12 of different sizes, and there is no need for adjustment or the like of the position at which the "separating plate" is disposed so as to correspond to the size. For this reason as well, the workability improves and the range of applications is broadened.

Moreover, the timing of the operation of and the number of times of operation of the respective actuators 60 (i.e., the timing of the displacement operation or the number of displacements of the suction cups 40 to be displaced, or which of the suction cups 40 are to be displaced, or the like) can be set arbitrarily. Therefore, as a result, the speed of generation and the positions of generation of the waves of the printing plate 12 which is being curved in a wave-like-form can be set optimally, and the ability to disjoin (ability to separate) the printing plate 12 from the printing plate 12 therebeneath can be greatly improved. For example, by moving the positions at which the printing plate 12 is curved (the positions of the waves), the entry rate of the air which enters in between that printing plate 12 and the printing plate 12 therebeneath can be accelerated, and the ability to disjoin (ability to separate) can be greatly improved. Accordingly, the time of the operation for removing/feeding the printing plate 12 and the time of the cycles of this removing/feeding operation can be greatly shortened.

In this way, at the sheet sucking/feeding device 50 relating to the present first embodiment, at the time when the uppermost printing plate 12 among a plurality of stacked printing plates 12 is sucked and separated and fed, the ability to disjoin (ability to separate) the printing plate 12 from the printing plate 12 therebeneath can be greatly improved. The uppermost printing plate can be reliably separated from the printing plate 12 therebeneath, and can be stably fed out.

Note that, in the sucking/feeding device 50 relating to the above-described first embodiment, the actuators 60 and the lift-up levers 64 structuring the suction cup operation device are disposed, together with the plural suction cups 40, at the single base plate 52 which is provided along the transverse direction of the printing plate 12, such that an assembly (a unit) is formed on the whole, and the entire sucking/feeding device 50 carries out the sucking/feeding operation. However, the present invention is not limited to the same, and the suction cup operation device of the actuators 60, the lift-up levers 64, and the like can be structured so as to be provided separately from the plural suction cups 40.

Figure 5:
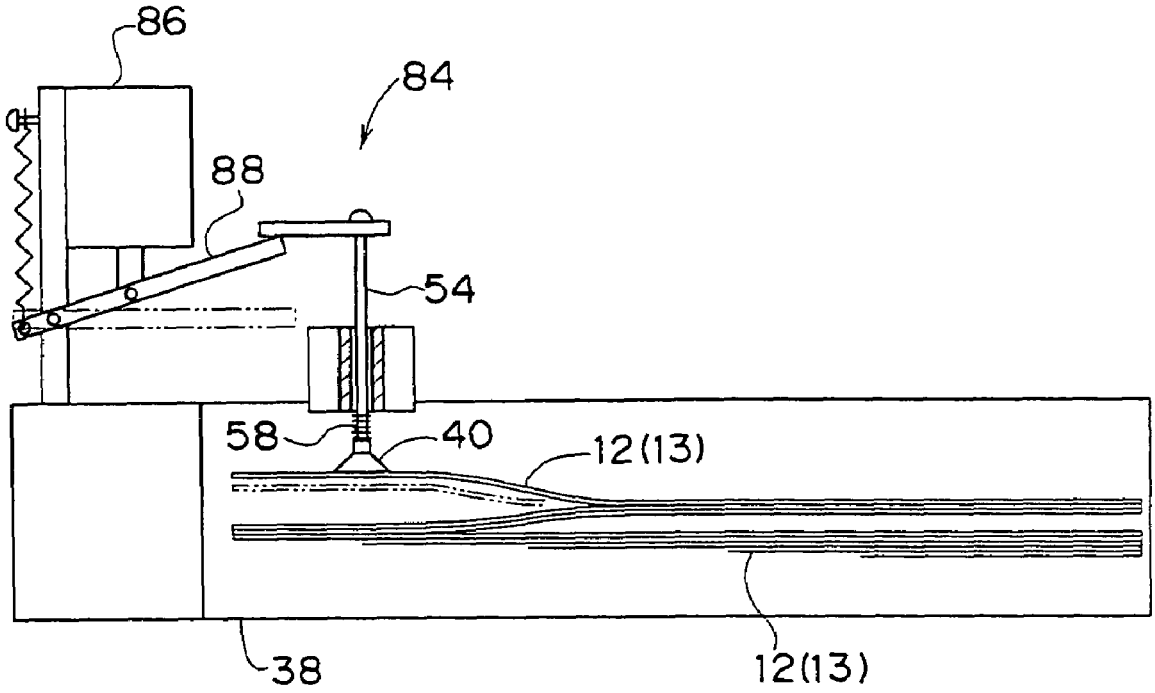
FIG. 5 is a side view showing a modified example of the sheet sucking/feeding device relating to the first embodiment of the present invention.

For example, as in the case of a sucking/feeding device 84 shown in FIG. 5, solenoids 86 and lift-up levers 88, which structure the suction cup operation device, are provided so as to correspond to the position of separating the printing plate 12 (the position at which the printing plate 12 is sucked and raised up by a predetermined amount). At the point in time when the printing plate 12 is sucked and is lifted up to this position of separation, the solenoids 86 are operated such that the suction cups 40 are displaced, and the uppermost printing plate 12 is separated from the printing plate 12 therebeneath and fed out.

Next, another embodiment of the present invention will be described.

Note that parts which are substantially the same as those of the above-described first embodiment are denoted by the same reference numerals as in the first embodiment, and description thereof is omitted.

Figure 6:
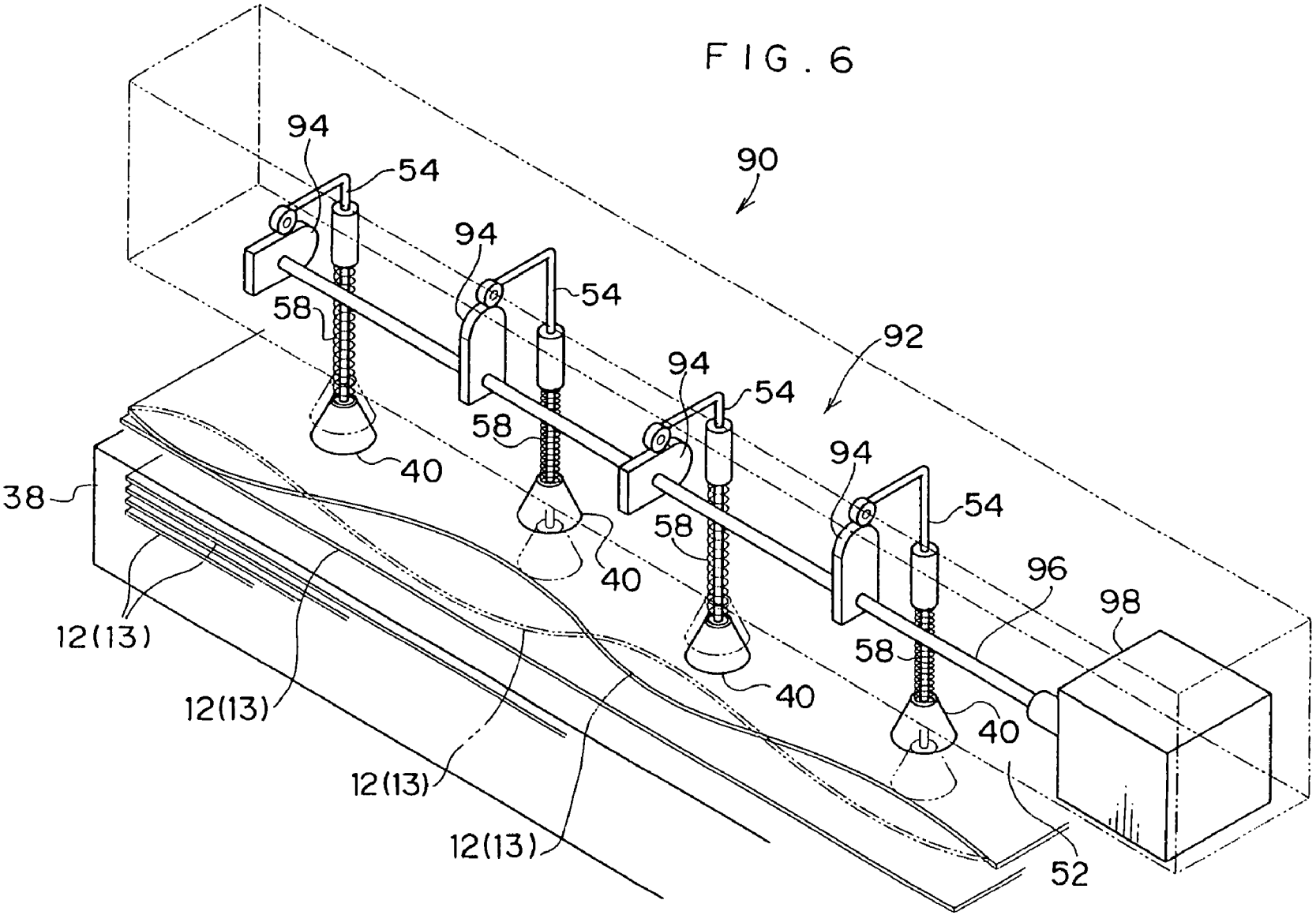
FIG. 6 is a perspective view showing the structure of a sheet sucking/feeding device relating to a second embodiment of the present invention.

The structure of a sucking/feeding device 90 relating to a second embodiment is shown in FIG. 6.

The sucking/feeding device 90 is equipped with a cam mechanism 92 serving as the suction cup operation device. At the cam mechanism 92, cams 94 are disposed so as to correspond to the respective suction cups 40. The respective cams 94 are connected, on a single axis, to a single connecting shaft 96. The connecting shaft 96 is connected to the rotating shaft of a motor 98. The cams 94 can independently engage with the respective suction cups. Due to the engagement, the cam 94 can lift the suction cup 40 up (displace the suction cup 40) by a predetermined amount (within the range of the buffer stroke). Moreover, in this case, at the point in time when the printing plate 12 is sucked by the plurality of suction cups 40 and is raised up by a predetermined amount (e.g., about 1 mm to about 200 mm), due to at least one of the cams 94 operating, at least one of the suction cups 40 is displaced, and the printing plate 12 which is being sucked is curved wavily along the transverse direction thereof.

Note that, in the present second embodiment as well, setting is carried out such that, at the time when the printing plate 12 is sucked and lifted up by a predetermined amount, every other cam 94 is operated simultaneously. In FIG. 6, the odd-numbered cams 94 are considered to be a group and simultaneously engage, and the even-numbered cams 94 are considered to be a group and simultaneously engage. Further, in this case, engagement by one of the groups of cams 94 grouped together as described above may be repeated plural times, or respective engagement operations of the respective groups of cams 94 may be carried out alternately.

In the sucking/feeding device 90 relating to the present second embodiment as well, the suction cups 40 suck the printing plate 12 as well as the uppermost interleaf sheet 13.

Here, at the point in time when the printing plate 12 has been sucked and raised up by a predetermined amount (e.g., about 1 mm to about 200 mm), the suction cup operation device, i.e., every other cam 94, is simultaneously engaged. In FIG. 6, the group of the odd-numbered cams 94 are simultaneously engaged, or the group of the even-numbered cams 94 are simultaneously engaged.

Therefore, the suction cups 40 connected to the engaged cams 94 are displaced upwardly. In this way, the uppermost printing plate 12 which is being sucked is curved in the shape of waves along the transverse direction (the direction along which the plural suction cups 40 are arranged) i.e., the printing plate 12 curves at the portions thereof sucked by the displaced suction cups 40 so as become wavy.

As a result, air enters in between the uppermost printing plate 12 which is being sucked by the suction cups 40 and the next (lower) printing plate 12 (interleaf sheet 13). That next (lower) printing plate 12 (interleaf sheet 13) is disjoined (separated) such that only the uppermost printing plate 12 is stably lifted out (singly fed out) from the cassette 38.

Here, the sucking/feeding device 90 relating to the present second embodiment is not a structure using a conventional, so-called "separating plate" for dissociating (separating) the printing plate 12 from the printing plate 12 (the interleaf sheet 13) therebeneath at the time of sucking and removing and feeding by the suction cups 40. Therefore, a "separating plate" does not get in the way at the time when, for example, the printing plates 12 are being loaded into the cassette 38, and the workability does not deteriorate. Further, because there is no "separating plate", the separated next printing plate 12 (the printing plate 12 beneath) does not ride up on the "separating plate". Problems in sucking at the time of the next sucking/feeding operation can be prevented from occurring, and a stable sucking/feeding operation can be ensured. In addition, the printing plate 12 is set in a wavy state due to at least one suction cup 40 among the plural suction cups 40, which are arranged along the transverse direction of the printing plate 12, being displaced. Therefore, the present invention can be applied as is to the printing plates 12 of different sizes, and there is no need for adjustment or the like of the position at which the "separating plate" is disposed so as to correspond to the size. For this reason as well, the workability improves and the range of applications is broadened.

Moreover, the timing of the engagement of and the number of times of operation of the respective cams 94 (i.e., the timing of the displacement operation or the number of displacements of the suction cups 40 to be displaced, or which of the suction cups 40 are to be displaced, or the like) can be set arbitrarily in accordance with the set angle of the cams 94, the configuration of the cams 94, and the like. Therefore, as a result, the speed of generation and the positions of generation of the waves of the printing plate 12 which is being curved in a wave-like-form can be set optimally, and the ability to disjoin (ability to separate) the printing plate 12 from the printing plate 12 therebeneath can be greatly improved. For example, by moving the positions at which the printing plate 12 is curved (the positions of the waves), the entry rate of the air which enters in between that printing plate 12 and the printing plate 12 therebeneath can be accelerated, and the ability to disjoin (ability to separate) can be greatly improved. Accordingly, the time of the operation for removing/feeding the printing plate 12 and the time of the cycles of this removing/feeding operation can be greatly shortened.

In this way, at the sheet sucking/feeding device 90 relating to the present second embodiment, at the time when the uppermost printing plate 12 among a plurality of stacked printing plates 12 is sucked and separated and fed, the ability to disjoin (ability to separate) the printing plate 12 from the printing plate 12 therebeneath can be greatly improved. The uppermost printing plate 12 can be reliably separated from the printing plate 12 therebeneath, and can be stably fed out.

Note that, in the present second embodiment, as described above, every other cam 94 is operated simultaneously. However, the operation of every other cam 94 may be repeated several times, or the operations of the respective groups of the cams 94 may be carried out alternately. In these cases, air is made to enter in even more reliably between the sucked printing plate 12 and the printing plate 12 therebeneath, which is even more effective.

The cams 94 which are operated simultaneously (i.e., which are considered to be a group) are not limited to the structure of every other cam 94 as described above. For example, a structure may be used in which every third cam 94 or every fourth cam 94 are operated simultaneously.

In the sucking/feeding device 90 relating to the above-described second embodiment, the cams 94 and the motor 98 structuring the suction cup operation device are disposed together with the plural suction cups 40, such that an assembly (a unit) is formed on the whole, and the entire sucking/feeding device 90 carries out the sucking/feeding operation. However, the present invention is not limited to the same, and the suction cup operation device of the cams 94, the motor 98 and the like can be structured so as to be provided separately from the plural suction cups 40.

Figure 7:
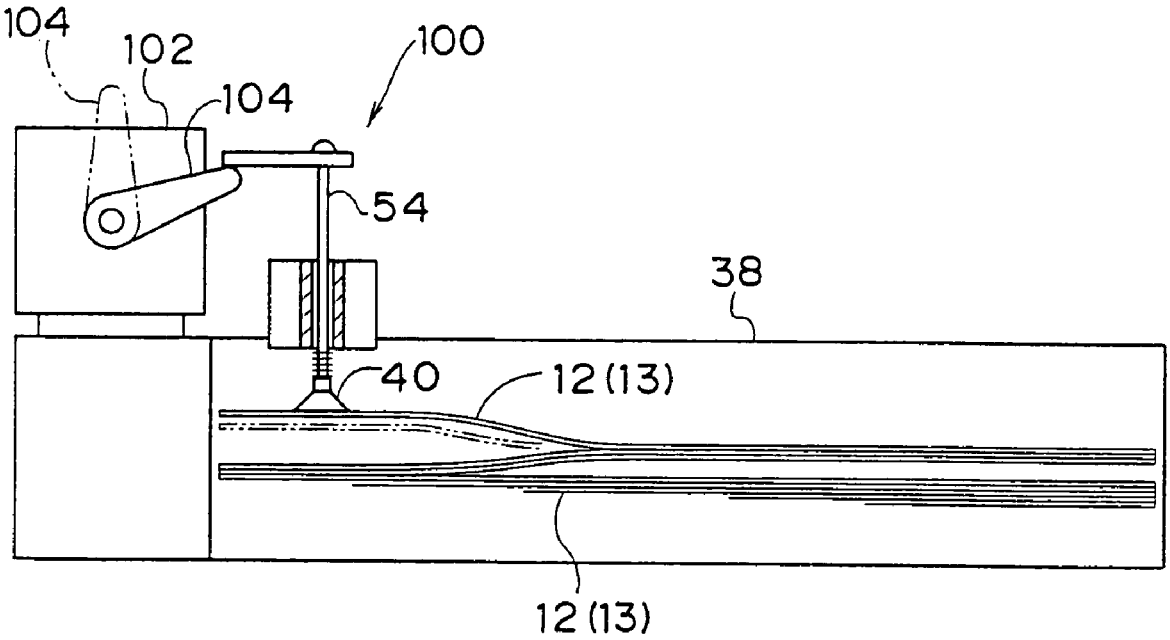
FIG. 7 is a side view showing a modified example of the sheet sucking/feeding device relating to the second embodiment of the present invention.

For example, as in the case of a sucking/feeding device 100 shown in FIG. 7, a motor 102 and cams 104, which structure the suction cup operation device, are provided so as to correspond to the position of separating the printing plate 12 (the position at which the printing plate 12 is sucked and raised up by a predetermined amount). At the point in time when the printing plate 12 is sucked and is lifted up to this position of separation, the motor 102 (the cams 104) are operated such that the suction cups 40 are displaced, and the uppermost printing plate 12 is separated from the printing plate 12 therebeneath and fed out.

Moreover, it is possible to fix the cams 94 and the cams 104, and not use the cams 94 driven by the motor 98 and the cams 104 driven by the motor 102 as described above.

Figure 8:
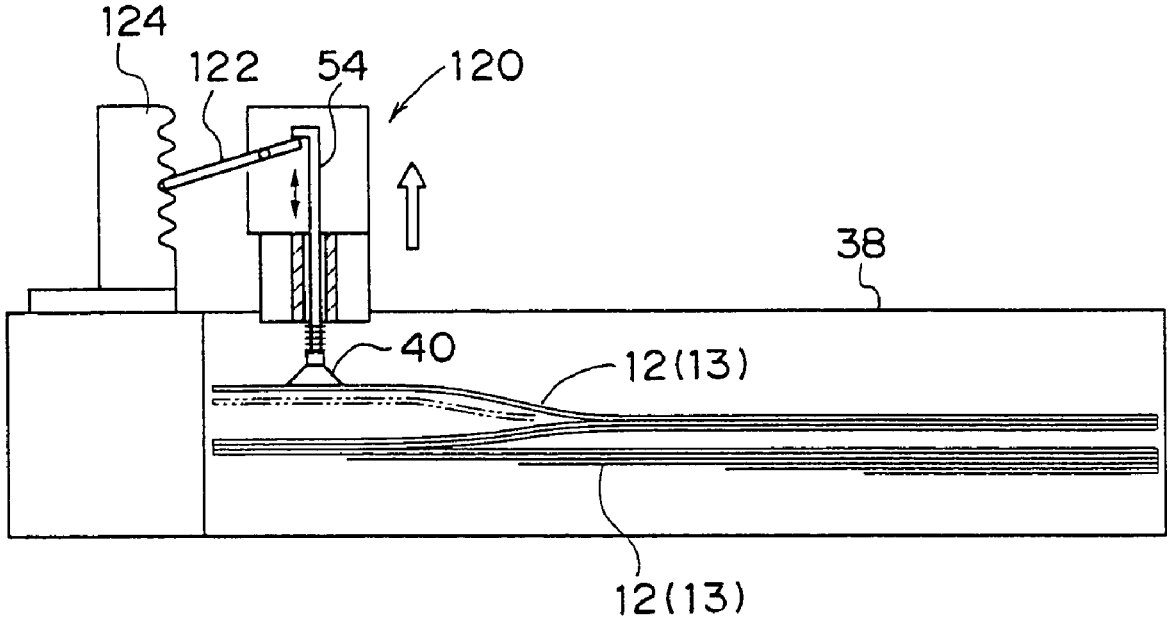
FIG. 8 is a side view showing a modified example of the sheet sucking/feeding device relating to the second embodiment of the present invention.

For example, as in the case of a sucking/feeding device 120 shown in FIG. 8, a structure is possible in which lift-up levers 122, which structure the suction cup operation device, form an assembly (a unit) together with the suction cups 40, and wave-shaped fixed cams 124 are provided so as to correspond to the position of separating the printing plate 12 (the position at which the printing plate 12 is sucked and raised up by a predetermined amount). At the point in time when the printing plate 12 is sucked and is lifted up to this position of separation, the lift-up levers 122 engage with the fixed cams 124, and the suction cups 40 are displaced.

Figure 9:
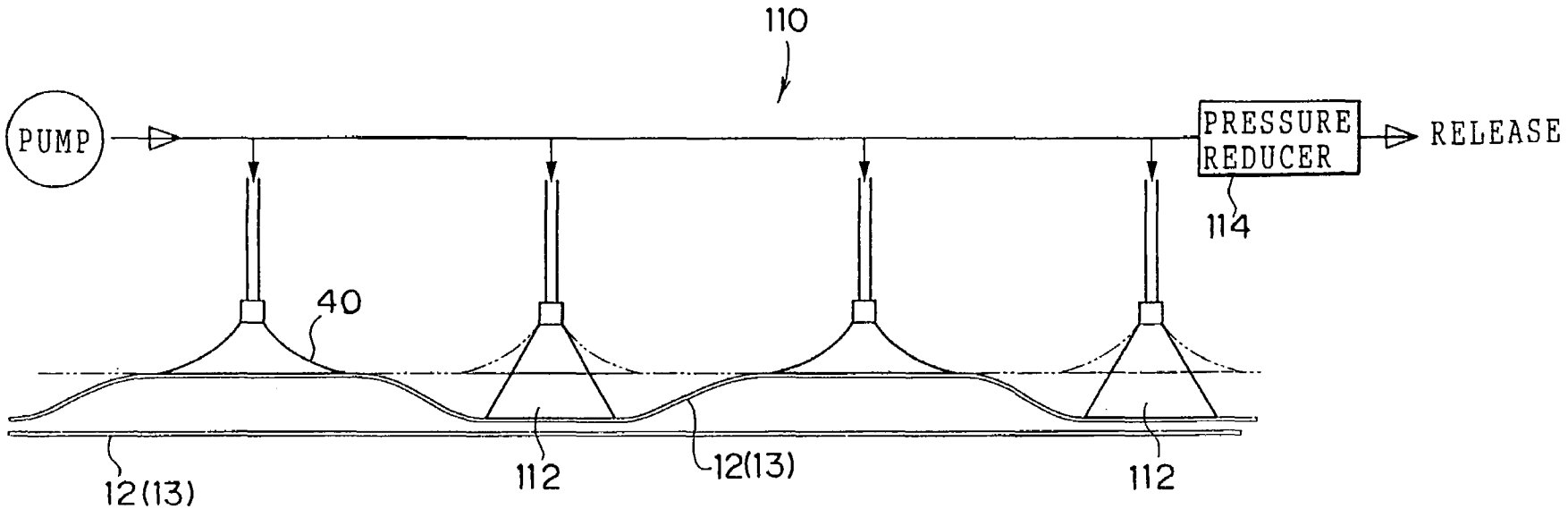
FIG. 9 is a front view showing the structure of a sheet sucking/feeding device relating to a third embodiment of the present invention.

Next, the structure of a sucking/feeding device 110 relating to a third embodiment and shown in FIG. 9 will be described.

This sucking/feeding device 110 is equipped with highly-rigid suction cups 112. The rigidity of the skirt portions of the highly-rigid suction cups 112 is set to be higher than that of the other suction cups 40. Moreover, the highly-rigid suction cups 112 are arranged alternately with the other suction cups 40. The highly-rigid suction cups 112 and the suction cups 40 are connected to a pressure reducer 114. Thus, when the pressure reducer 114 reduces the suction negative pressure within a range in which the highly-rigid suction cups 112 and the suction cups 40 can suck the printing plate 12, the highly-rigid suction cups 112 deform due to the rigidity (reaction force) of their skirt portions. In other words, the skirt portions are extended so as to approach their natural states, and the sucked positions of the printing plate 12 are displaced. In this way, the portions of the printing plate 12 sucked by the highly-rigid suction cups 112 are pushed down with respect to the other regions of the printing plate 12, and the printing plate 12 is curved in wave shapes along the transverse direction.

Note that, in the present third embodiment as well, settings are carried out such that, when the printing plate 12 is sucked and raised by a predetermined amount, pressure is reduced simultaneously at the respective highly-rigid suction cups 112. Further, in this case, the reduction of pressure of the highly-rigid suction cups 112 may be repeated plural times.

In the sucking/feeding device 110 relating to the present third embodiment, the suction cups 40 and the highly-rigid suction cups 112 suck the printing plate 12 together with the uppermost interleaf sheet 13.

Here, at the point in time when the printing plate 12 is sucked and raised up by a predetermined amount (e.g., about 1 mm to about 200 mm), the suction negative pressure of the highly-rigid suction cups 112 and the suction cups 40 is reduced by the pressure reducer 114 within a range in which the printing plate 12 can be sucked. In this way, the skirt portions of the highly-rigid suction cups 112 deform due to the rigidity (reaction force) thereof (i.e., are extended so as to approach their natural states), and the sucked positions of the printing plate 12 are displaced.

Therefore, the portions of the printing plate 12 sucked by the highly-rigid suction cups 112 are pushed down lower than the other portions, and the printing plate 12 is curved in the shape of waves along the transverse direction (the direction along which the suction cups 40 and the highly-rigid suction cups 112 are arranged) (i.e., the printing plate 12 curves at the portions thereof sucked by the highly-rigid suction cups 112 so as become wavy).

As a result, air enters in between the uppermost printing plate 12, which is being sucked by the suction cups 40 and the highly-rigid suction cups 112, and the next (lower) printing plate 12 (interleaf sheet 13). That next (lower) printing plate 12 (interleaf sheet 13) is disjoined (separated) such that only the uppermost printing plate 12 is stably lifted out (singly fed out) from the cassette 38.

Here, the sucking/feeding device 110 relating to the present third embodiment is not a structure using a conventional, so-called "separating plate" for dissociating (separating) the printing plate 12 from the printing plate 12 (the interleaf sheet 13) therebeneath at the time of sucking and removing and feeding by the suction cups 40 and the highly-rigid suction cups 112. Therefore, the workability does not deteriorate. Further, because there is no "separating plate", the separated next printing plate 12 (the printing plate 12 beneath) does not ride up on the "separating plate". Problems in sucking at the time of the next sucking/feeding operation can be prevented from occurring, and a stable sucking/feeding operation can be ensured. In addition, the printing plate 12 is set in a wavy state due the suction negative pressure of the highly-rigid suction cups 112, which are arranged along the transverse direction of the printing plate 12, being reduced. Therefore, the present invention can be applied as is to the printing plates 12 of different sizes, and there is no need for adjustment or the like of the position at which the "separating plate" is disposed so as to correspond to the size. For this reason as well, the workability improves and the range of applications is broadened.

In this way, in the sheet sucking/feeding device 110 relating to the present third embodiment, at the time when the uppermost printing plate 12 among a plurality of stacked printing plates 12 is sucked and removed and fed, the ability to disjoin (ability to separate) the printing plate 12 from the printing plate 12 therebeneath can be greatly improved. The uppermost printing plate can be reliably separated from the printing plate 12 therebeneath, and can be stably fed out.

Note that, in the present third embodiment, as described above, the pressure of the highly-rigid suction cups 112, which are disposed alternately with the suction cups 40, is reduced simultaneously. However, the operation of reducing the suction negative pressure of the highly-rigid suction cups 112 (the suction cups 40) may be repeated plural times. In this way, air is made to enter in even more reliably between the sucked printing plate 12 and the printing plate 12 therebeneath, which is even more effective.

A structure in which, as described above, every other one of the suction cups is the highly-rigid suction cup 112, is preferable. However, it suffices for at least every other one of the suction cups to be the highly-rigid suction cup 112. For example, a structure maybe used in which the highly-rigid suction cup 112 is provided as every third suction cup or every fourth suction cup.

In the above-described third embodiment, the reduction of the suction negative pressure of the suction cups 40 and the highly-rigid suction cups 112 is carried out simultaneously. However, the present invention is not limited to the same. A structure may be used in which the reduction in the suction negative pressure by the pressure reducer 114 is carried out only on (solely on) the highly-rigid suction cups 112. In this case, it suffices to not change the rigidities of the respective suction cups, and to use only the suction cups 40 or only the highly-rigid suction cups 112.

As described above, the sheet sucking/feeding device relating to the present invention has the excellent effect that, at the time of sucking and feeding out an uppermost sheet among a plurality of stacked sheets, this uppermost sheet can be reliably separated from the next sheet (the sheet therebeneath) and stably fed out.

What is claimed is:

1. A sheet sucking/feeding device which sucks an uppermost sheet among a plurality of stacked sheets, and separates the uppermost sheet from a sheet therebeneath and feeds the uppermost sheet out, said device comprising:

a plurality of suction cups provided at predetermined intervals along a transverse direction of the sheet, and sucking the sheet; and a suction cup operation device which is operative to displace the plurality of suction cups over a predetermined stroke in a suction cup axial direction, and which, at a point in time when the sheet is sucked by the plurality of suction cups and raised up by a predetermined amount, displaces at least every other one of the plurality of suction cups independently of others of the suction cups, so as to cause the sucked sheet to curve wavily along the transverse direction;

wherein the at least every other one of the plurality of suction cups comprise a first group of suction cups, and the others comprise at least a second group of suction cups.

2. The sheet sucking/feeding device of claim 1, wherein the suction cup operation device comprises actuators connected independently to the respective suction cups, and when the sheet is sucked and raised up by the predetermined amount, the suction cup operation device displaces the suction cups by simultaneously driving at least every other one of the actuators.

3. The sheet sucking/feeding device of claim 2, wherein the at least every other one of the actuators are a group of actuators, and a plurality of groups of actuators are set overall, and the respective groups of actuators are driven alternately.

4. The sheet sucking/feeding device of claim 1, wherein the suction cup operation device comprises a cam mechanism having cams which engage independently with the respective suction cups, and when the sheet is sucked and raised up by the predetermined amount, the suction cup operation device displaces the suction cups by simultaneously making at least every other one of the cams of the cam mechanism engage.

5. The sheet sucking/feeding device of claim 4, wherein at least every other one of the cams are a group of cams, and a plurality of groups of cams are set overall, and the respective groups of cams are driven alternately.

6. The sheet sucking/feeding device of claim 1, wherein a rigidity of a skirt portion of the first group of suction cups is greater than a rigidity of a skirt portion of the at least second group of suction cups, the suction cup operation device comprises a pressure reducer reducing a suction negative pressure of at least the first group of suction cups among the suction cups, and when the sheet is sucked and raised up by the predetermined amount, the suction cup operation device deforms the skirt portions of the first group of suction cups by reducing the suction negative pressure of the first group of suction cups by the pressure reducer.

7. The sheet sucking/feeding device of claim 1, wherein a rigidity of a skirt portion of the first group of suction cups is greater than a rigidity of a skirt portion of the at least second group of suction cups, the suction cup operation device comprises a pressure reducer reducing a suction negative pressure of at least one of the first group and second group of the suction cups, and when the sheet is sucked and raised up by the predetermined amount, the suction cup operation device deforms the skirt portions of the at least one of the first group and second group of suction cups by simultaneously reducing the suction negative pressure of the at least one of the first group and second group of suction cups by the pressure reducer.

8. The sheet sucking/feeding device of claim 1, wherein skirt portions of the suction cups have a same rigidity, the suction cup operation device includes a pressure reducer individually reducing suction negative pressures of the suction cups, and when the sheet is sucked and raised up by the predetermined amount, the suction cup operation device reduces the suction negative pressure of at least every other one of the plurality of suction cups by the pressure reducer so as to deform the skirt portion of said at least every other one of the plurality of suction cups.

9. The sheet sucking/feeding device of claim 2, wherein the actuators are structured to include solenoids.

10. The sheet sucking/feeding device of claim 9, wherein the actuators are respectively connected to shafts of the suction cups via lift-up levers, and can raise up the suction cups.

11. The sheet sucking/feeding device of claim 10, wherein springs for ensuring a buffer stroke are wound on the shafts of the suction cups.

12. The sheet sucking/feeding device of claim 10, wherein the actuators and the lift-up levers are disposed, together with the suction cups, at a single base plate provided along the transverse direction of the sheets, so as to form a unit.

13. The sheet sucking/feeding device of claim 10, wherein the suction cup operation device having the actuators and the lift-up levers is provided separately from the suction cups.

14. A method of sucking and feeding a sheet which sucks an uppermost sheet among a plurality of stacked sheets, and separates the uppermost sheet from a sheet therebeneath and feeds the uppermost sheet out, said method comprising:

sucking the sheet by a plurality of suction cups provided along a transverse direction of the sheet; and after sucking the sheet, raising the sheet up by a predetermined amount by the plurality of suction sups, and causing the sheet to curve wavily along the transverse direction by stroke-displacing at least every other one of the plurality of suction cups independently of others of the plurality of suction cups wherein the at least every other one of the plurality of suction cups comprise a first group of suction cups, and the others comprise at least a second group of suction cups.

15. The method of claim 14, wherein the sucking the sheet includes sucking the sheet by a plurality of suction cups provided along the transverse direction of the sheet.

16. The method of claim 15, wherein the raising the sheet up includes stroke-displacing at least one of the suction cups independently of others of the suction cups, in an axial direction of the suction cups.

17. The method of claim 15, wherein the causing the sheet to curve includes causing at least every other cam mechanism among cam mechanisms corresponding to the respective suction cups, to engage with a corresponding suction cup and displace the corresponding suction cup.

18. The method of claim 15, wherein causing the sheet to curve includes partially deforming at least every other one of the plurality of suction cups by reducing a suction pressure of the at least one suction cup.

19. The method of claim 15, wherein the causing the sheet to curve includes repeatedly reducing pressure of the suction cups.

20. The method of claim 15, wherein causing the sheet to curve includes reducing pressure in accordance with a combination of the suction cups and highly-rigid suction cups.

* * * * *